US011033773B1

(12) United States Patent
Barton et al.

(10) Patent No.: US 11,033,773 B1
(45) Date of Patent: Jun. 15, 2021

(54) HANDLE FINGER STOP PROTRUSION AND HANDLE ASSEMBLY USING THE SAME

(71) Applicant: Barton Innovations, LLC, Waynesfield, OH (US)

(72) Inventors: Thomas Jeffrey Barton, Waynesfield, OH (US); David Joseph Barton, Waynesfield, OH (US); Sara Anne Barton, Waynesfield, OH (US)

(73) Assignee: Barton Innovations, LLC, Waynesfield, OH (US)

( * ) Notice: Subject to any disclaimer, the term of this patent is extended or adjusted under 35 U.S.C. 154(b) by 0 days.

(21) Appl. No.: 15/933,018

(22) Filed: Mar. 22, 2018

Related U.S. Application Data

(60) Provisional application No. 62/476,614, filed on Mar. 24, 2017.

(51) Int. Cl.
*A63B 21/00* (2006.01)
*A63B 23/12* (2006.01)
*A63B 23/035* (2006.01)

(52) U.S. Cl.
CPC .... *A63B 21/4035* (2015.10); *A63B 23/03516* (2013.01); *A63B 23/1281* (2013.01); *A63B 21/151* (2013.01)

(58) Field of Classification Search
CPC ..... A63B 21/0004; A63B 21/00069; A63B 21/00072; A63B 21/00185; A63B 21/062–068; A63B 21/072–0724; A63B 21/078; A63B 21/151–152; A63B 21/159; A63B 21/4023; A63B 21/4027;
(Continued)

(56) References Cited

U.S. PATENT DOCUMENTS 886,591 A * 5/1908 Finger ..... A63B 23/16 482/47
1,435,216 A * 11/1922 Davis ..... F16B 39/26 411/261

(Continued)

OTHER PUBLICATIONS

"Stainless Steel Eye Bolt with Nut (¼"-20×3")", Feb. 7, 2014 (retrieved Jul. 30, 2019), Amazon.com, 3 pages. Retrieved from the Internet: https://www.amazon.com/Hillman-4289-Stainless-Steel-5-Pack/dp/B00IAVMG8U/ref=sr_1_5?keywords=stainless+steel+eye+bolt+with+nut&qid=1564517951&s=gateway&sr=8-5 (Year: 2014).*

(Continued)

*Primary Examiner* — Megan Anderson
*Assistant Examiner* — Kathleen Vermillera
(74) *Attorney, Agent, or Firm* — The Law Office of Patrick F. O'Reilly III, LLC

(57) ABSTRACT

A handle finger stop protrusion is disclosed herein. The handle finger stop protrusion is configured to be coupled to a handle body portion of a handle assembly. The handle finger stop protrusion includes a main body portion, the main body portion configured to be coupled to and extend outwardly from a first surface of the handle body portion, the main body portion configured to receive a thumb of a hand of a user pressing thereagainst so that the thumb of the user is configured to oppose a plurality of fingers other than the thumb of the hand of the user wrapped around an edge of the handle body portion so as to create a secure and safe grip of the handle assembly by the user. A handle assembly that includes at least one handle finger stop protrusion is also disclosed herein.

13 Claims, 7 Drawing Sheets

(58) Field of Classification Search

CPC ..... A63B 21/4033; A63B 21/4035; A63B 21/4039; A63B 21/4041; A63B 21/4049; A63B 22/0046; A63B 22/0076; A63B 23/035; A63B 23/03516; A63B 23/03525; A63B 23/12–1236; A63B 23/1245; A63B 23/1281; A63B 23/14; A63B 23/16; A63B 69/0048; A63B 69/0057–0059; A63B 69/06; A63B 2069/062; A63B 2069/066; A63B 71/0054; A63B 2071/0072; A63B 2225/09; A63B 2225/093; A61H 1/0285; A61H 1/0288

USPC ..... 482/38, 148; 403/259

See application file for complete search history.

(56) References Cited

U.S. PATENT DOCUMENTS

| | | | | |
|---|---|---|---|---|
| 1,694,992 | A | 12/1928 | Stoeffler | |
| 3,436,090 | A | 4/1969 | Lange et al. | |
| 4,147,356 | A * | 4/1979 | Brandell | A63B 69/3673 473/271 |
| 4,664,370 | A * | 5/1987 | Finch | A63B 23/12 482/45 |
| 5,136,911 | A * | 8/1992 | Wyss | A61H 1/0288 482/48 |
| 5,205,802 | A * | 4/1993 | Swisher | A63B 21/00047 482/100 |
| 5,287,870 | A | 2/1994 | Rhodes | |
| 5,374,226 | A * | 12/1994 | Grahm | A63B 23/16 482/44 |
| 5,411,453 | A * | 5/1995 | Wilson | A63B 1/00 482/148 |
| 5,711,716 | A * | 1/1998 | O'Brien | A63B 69/0059 473/201 |
| 5,761,767 | A | 6/1998 | Barton | |
| 6,305,051 | B1 | 10/2001 | Cho | |
| 6,637,773 | B1 | 10/2003 | Trinen et al. | |
| 6,916,260 | B1 | 7/2005 | Poteet | |
| 6,988,745 | B2 | 1/2006 | Trinen et al. | |
| 7,288,051 | B1 | 10/2007 | Phillips | |
| 8,113,993 | B2 | 2/2012 | McVan | |
| 8,460,121 | B2 * | 6/2013 | Pinns | A63B 69/3608 473/212 |
| 8,678,020 | B2 | 3/2014 | Renaud-Goud et al. | |
| D818,058 | S | 5/2018 | Barton et al. | |
| D818,059 | S | 5/2018 | Barton et al. | |
| D818,060 | S | 5/2018 | Barton et al. | |
| D818,061 | S | 5/2018 | Barton et al. | |
| D818,063 | S | 5/2018 | Barton et al. | |
| 2010/0190612 | A1 * | 7/2010 | Cook | A63B 71/023 482/38 |
| 2011/0203076 | A1 | 8/2011 | Sonnendorfer et al. | |
| 2011/0300999 | A1 * | 12/2011 | Cavaliere | A63B 21/0608 482/108 |
| 2014/0329650 | A1 | 11/2014 | Watry | |

OTHER PUBLICATIONS

MAG Grip Products Webpage, MAG Maximum Advantage Grip Website, Web page <http://maxagrip.com/products. html>, 2 pages, dated Oct. 17, 2013, retrieved from Internet Archive Wayback Machine <https://web.archive.org/web/20131017005713/http://maxagrip.com/products.html> on Sep. 14, 2016.

Close Grip Neutral on MAG Grip Products Webpage, MAG Maximum Advantage Grip Website, Web page <http://maxagrip.com/products.html>, 2 pages, dated Oct. 17, 2013, retrieved from Internet Archive Wayback Machine <https://web.archive.org/web/20131017005713/http://maxagrip.com/products.html> on Sep. 14, 2016.

Close Grip Pronate on MAG Grip Products Webpage, MAG Maximum Advantage Grip Website, Web page <http://maxagrip.com/products.html>, 2 pages, dated Oct. 17, 2013, retrieved from Internet Archive Wayback Machine <https://web.archive.org/web/20131017005713/http://maxagrip.com/products.html> on Sep. 14, 2016.

Close Grip Supinate on MAG Grip Products Webpage, MAG Maximum Advantage Grip Website, Web page <http://maxagrip.com/products.html>, 2 pages, dated Oct. 17, 2013, retrieved from Internet Archive Wayback Machine <https://web.archive.org/web/20131017005713/http://maxagrip.com/products.html> on Sep. 14, 2016.

Medium Grip Neutral on MAG Grip Products Webpage, MAG Maximum Advantage Grip Website, Web page <http://maxagrip.com/products.html>, 2 pages, dated Oct. 17, 2013, retrieved from Internet Archive Wayback Machine <https://web.archive.org/web/20131017005713/http://maxagrip.com/products.html> on Sep. 14, 2016.

Medium Grip Pronate on MAG Grip Products Webpage, MAG Maximum Advantage Grip Website, Web page <http://maxagrip.com/products.html>, 2 pages, dated Oct. 17, 2013, retrieved from Internet Archive Wayback Machine <https://web.archive.org/web/20131017005713/http://maxagrip.com/products.html> on Sep. 14, 2016.

Medium Grip Supinate on MAG Grip Products Webpage, MAG Maximum Advantage Grip Website, Web page <http://maxagrip.com/products.html>, 2 pages, dated Oct. 17, 2013, retrieved from Internet Archive Wayback Machine <https://web.archive.org/web/20131017005713/http://maxagrip.com/products.html> on Sep. 14, 2016.

* cited by examiner

HANDLE FINGER STOP PROTRUSION AND HANDLE ASSEMBLY USING THE SAME

CROSS-REFERENCE TO RELATED APPLICATIONS

This patent application claims priority to, and incorporates by reference in its entirety, U.S. Provisional Patent Application No. 62/476,614, entitled "Handle Finger Stop Protrusion And Handle Assembly Using The Same", filed on Mar. 24, 2017.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a handle finger stop protrusion and handle assembly using the same. More particularly, the invention relates to a handle finger stop protrusion and handle assembly especially well-suited for exercise equipment, weight lifting equipment, or weight training equipment.

2. Background

Conventional handles and bars for weight training typically are round, and are usually formed from steel and range in diameter from one to two inches. The trainee grasps the handle or bar with his or hers fingers wrapping around the circumference of the bar. There are exceptions to this normal use of a round bar as in bench pressing and triceps exercises, such as the triceps push downs. A bench press is an exercise where the trainee lies on his back and grasps a weighted bar that is held in a rack. The trainee then grasps and lifts the bar to arm's length and then lowers it to his chest. He then pushes it from his chest back to arm's length. This comprises one repetition. A usual workout for the bench press would be a trainee doing ten repetitions and then pausing for a rest. This would be a set. Usually a trainee would do three to four sets of said exercise. Some trainees find that by putting their thumbs beside their index fingers and resting the bar in their palms that it is a more comfortable grip for them when doing a bench press routine. By doing the bench press with this type of grip on the bar, the possibility is created for the bar to roll out of the trainee's hand because the thumb is not in the position to keep the bar locked into the trainee's grasp/hand. This is capable of causing serious injury to the trainee as a heavy bar can fall to their chest.

Another common exercise and one related to the aforedescribed invention, is the triceps push down. With this exercise, a trainee grasps a round bar that is usually straight or V-shaped. The trainee stands in front of this bar, which is attached to a cable leading to a weight stack and is about chest high. He or she then grasps the bar with his palms facing downward and keeps his elbows at his side. The elbows will be bent at a 90 degree angle or greater in this position. He then pushes down with his hands and then straightens his arms. He then returns to the starting position. This comprises one repetition. Normally ten repetitions would comprise one set. As with the bench press, some trainees find it to be more comfortable to grasp the bar with their thumb beside their index finger. As with the bench press described above, this type of grip may result in the bar rolling from the trainee's hands, and thus cause serious injury.

Therefore, what is needed is a handle assembly with one or more handle finger stop protrusions that will provide a user with a safe, secure grip while using a weightlifting handle or bar. Moreover, a handle finger stop protrusion is needed that provides a buttress for the thumb to push against while grasping a weightlifting handle or bar. Furthermore, there is a need for a handle finger stop protrusion that is capable of forming a buttress on existing weightlifting handles or bars. In addition, what is needed is a handle finger stop protrusion that can be attached to an existing weightlifting handle or can be molded or fabricated into a new weightlifting handle.

BRIEF SUMMARY OF EMBODIMENTS OF THE INVENTION

Accordingly, the present invention is directed to a handle finger stop protrusion and handle assembly using the same that substantially obviates one or more problems resulting from the limitations and deficiencies of the related art.

In accordance with one or more embodiments of the present invention, there is provided a handle assembly configured to be attached to a movable or fixed device and upon which a hand of a user can perform gripping, pulling, and lifting movements. The handle assembly includes a handle body portion, the handle body portion including a first surface and a second surface, the second surface being oppositely disposed relative to the first surface, the first surface of the handle body portion configured to receive a palm of at least one hand of a user disposed thereon, the handle body portion further including a first edge and a second edge, the second edge being oppositely disposed relative to the first edge, the first edge configured to accommodate a plurality of fingers other than a thumb of the at least one hand of the user wrapped therearound; and at least one finger stop protrusion coupled to and extending outwardly from the first surface of the handle body portion, the at least one finger stop protrusion configured to receive the thumb of the at least one hand of a user pressing thereagainst so that the thumb of the user is configured to oppose the plurality of fingers of the at least one hand of the user wrapped around the first edge so as to create a secure and safe grip of the handle assembly by the user.

In a further embodiment of the present invention, the handle body portion is in the form of an elongate flat bar.

In yet a further embodiment, the first surface of the handle body portion is configured to receive the palms of both the right and lefts hands of the user disposed thereon, and wherein the first edge of the handle body portion is configured to accommodate pluralities of fingers other than thumbs from both the right and left hands of the user wrapped therearound.

In still a further embodiment, the at least one finger stop protrusion comprises a pair of spaced-apart finger stop protrusions, each of the pair of spaced-apart finger stop protrusions coupled to and extending outwardly from the first surface of the handle body portion, and each of the pair of spaced-apart finger stop protrusions configured to accommodate a respective thumb of a respective hand of the user.

In yet a further embodiment, the at least one finger stop protrusion has a cross-sectional body shape selected from the group consisting of: (i) circular, (ii) rectangular, (iii) square, (iv) elliptical, (v) flat bar shaped, and (vi) crescent shaped.

In still a further embodiment, the at least one finger stop protrusion is flat bar shaped, a longitudinal axis of the flat bar shaped finger stop protrusion being disposed at an acute angle relative to the second edge of the handle body portion so as to angularly orient the thumb of the user on the first surface of the handle body portion.

In yet a further embodiment, the at least one finger stop protrusion is fixedly secured to the handle body portion by welding or other similar means.

In still a further embodiment, the at least one finger stop protrusion is removably attached to the handle body portion.

In yet a further embodiment, the at least one finger stop protrusion comprises a main body portion and a connecting shaft extending outwardly from a side of the main body portion, the connecting shaft of the at least one finger stop protrusion configured to attach the at least one finger stop protrusion to the handle body portion by engaging with a recess or aperture disposed in the handle body portion.

In still a further embodiment, the connecting shaft of the at least one finger stop protrusion comprises a non-threaded section and a threaded section, the non-threaded section of the connecting shaft of the at least one finger stop protrusion configured to be received within the recess or aperture of the handle body portion, and the threaded section of the connecting shaft of the at least one finger stop protrusion configured to engage with a nut for securing the at least one finger stop protrusion to the handle body portion.

In yet a further embodiment, the non-threaded section of the connecting shaft of the at least one finger stop protrusion is circular in shape and the recess or aperture of the handle body portion has a corresponding circular shape so as to allow the at least one finger stop protrusion to be rotatably adjusted relative to the handle body portion by the user.

In still a further embodiment, the non-threaded section of the connecting shaft of the at least one finger stop protrusion is polygonal in shape and the recess or aperture of the handle body portion has a corresponding polygonal shape so as to allow the at least one finger stop protrusion to be incrementally adjustable in a plurality of different angular orientations relative to the handle body portion by the user, while preventing the at least one finger stop protrusion from being freely rotatable relative to the handle body portion.

In yet a further embodiment, the connecting shaft of the at least one finger stop protrusion comprises a plurality of external threads disposed thereon and the recess or aperture disposed in the handle body portion comprises a plurality of corresponding internal threads, the plurality of external threads on the connecting shaft of the at least one finger stop protrusion configured to be threadingly engaged with the plurality of internal threads of the recess or aperture disposed in the handle body portion so as to secure the at least one finger stop protrusion to the handle body portion.

In still a further embodiment, the handle assembly further comprises a connector member configured to attach the handle assembly to the movable or fixed device.

In yet a further embodiment, the connector member comprises a main body portion and a connecting shaft extending outwardly from a side of the main body portion, the connecting shaft of the connector member configured to attach the connector member to the handle body portion by engaging with a recess or aperture disposed in the handle body portion.

In still a further embodiment, the main body portion of the connector member comprises an aperture disposed therethrough for receiving a cable or chain for attaching the connector member to the movable or fixed device.

In yet a further embodiment, the connector member is in the form of an eye bolt.

In still a further embodiment, the connecting shaft of the connector member comprises a non-threaded section and a threaded section, the non-threaded section of the connecting shaft of the connector member configured to be received within the recess or aperture of the handle body portion, and the threaded section of the connecting shaft of the connector member configured to engage with a nut for securing the connector member to the handle body portion.

In yet a further embodiment, the non-threaded section of the connecting shaft of the connector member is polygonal in shape and the recess or aperture of the handle body portion has a corresponding polygonal shape so as to allow the connector member to be incrementally adjustable in a plurality of different angular orientations relative to the handle body portion by the user, while preventing the connector member from being freely rotatable relative to the handle body portion.

In accordance with one or more other embodiments of the present invention, there is provided a handle finger stop protrusion configured to be coupled to a handle body portion of a handle assembly. The handle finger stop protrusion includes a main body portion, the main body portion configured to be coupled to and extend outwardly from a first surface of the handle body portion, the main body portion configured to receive a thumb of a hand of a user pressing thereagainst so that the thumb of the user is configured to oppose a plurality of fingers other than the thumb of the hand of the user wrapped around an edge of the handle body portion so as to create a secure and safe grip of the handle assembly by the user.

In a further embodiment of the present invention, the main body portion has a cross-sectional body shape selected from the group consisting of: (i) circular, (ii) rectangular, (iii) square, (iv) elliptical, (v) flat bar shaped, and (vi) crescent shaped.

In yet a further embodiment, the handle finger stop protrusion further comprises a connecting shaft extending outwardly from a side of the main body portion, the connecting shaft configured to attach the handle finger stop protrusion to the handle body portion by engaging with a recess or aperture disposed in the handle body portion.

In still a further embodiment, the connecting shaft comprises a non-threaded section and a threaded section, the non-threaded section of the connecting shaft configured to be received within the recess or aperture of the handle body portion, and the threaded section of the connecting shaft configured to engage with a nut for securing the handle finger stop protrusion to the handle body portion.

In yet a further embodiment, the non-threaded section of the connecting shaft of the handle finger stop protrusion is circular in shape and the recess or aperture of the handle body portion has a corresponding circular shape so as to allow the handle finger stop protrusion to be rotatably adjusted relative to the handle body portion by the user.

In still a further embodiment, the non-threaded section of the connecting shaft of the handle finger stop protrusion is polygonal in shape and the recess or aperture of the handle body portion has a corresponding polygonal shape so as to allow the handle finger stop protrusion to be incrementally adjustable in a plurality of different angular orientations relative to the handle body portion by the user, while preventing the handle finger stop protrusion from being freely rotatable relative to the handle body portion.

In yet a further embodiment, the connecting shaft of the handle finger stop protrusion comprises a plurality of external threads disposed thereon and the recess or aperture disposed in the handle body portion comprises a plurality of corresponding internal threads, the plurality of external threads on the connecting shaft of the handle finger stop protrusion configured to be threadingly engaged with the plurality of internal threads of the recess or aperture disposed in the handle body portion so as to secure the handle finger stop protrusion to the handle body portion.

In accordance with yet one or more other embodiments of the present invention, there is provided a handle assembly configured to be attached to a movable or fixed device and upon which a hand of a user can perform gripping, pulling, and lifting movements. The handle assembly includes a handle body portion, the handle body portion including a first surface and a second surface, the second surface being oppositely disposed relative to the first surface, the first surface of the handle body portion configured to receive a first portion of at least one hand of a user disposed thereon, the handle body portion further including a first edge and a second edge, the second edge being oppositely disposed relative to the first edge, the first edge configured to accommodate a second portion of the at least one hand of the user wrapped therearound; and at least one protrusion coupled to and extending outwardly from the first surface of the handle body portion, the at least one protrusion configured to receive a third portion of the at least one hand of a user pressing thereagainst so that the third portion of the at least one hand of the user is configured to oppose the second portion of the at least one hand of the user wrapped around the first edge so as to create a secure and safe grip of the handle assembly by the user.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
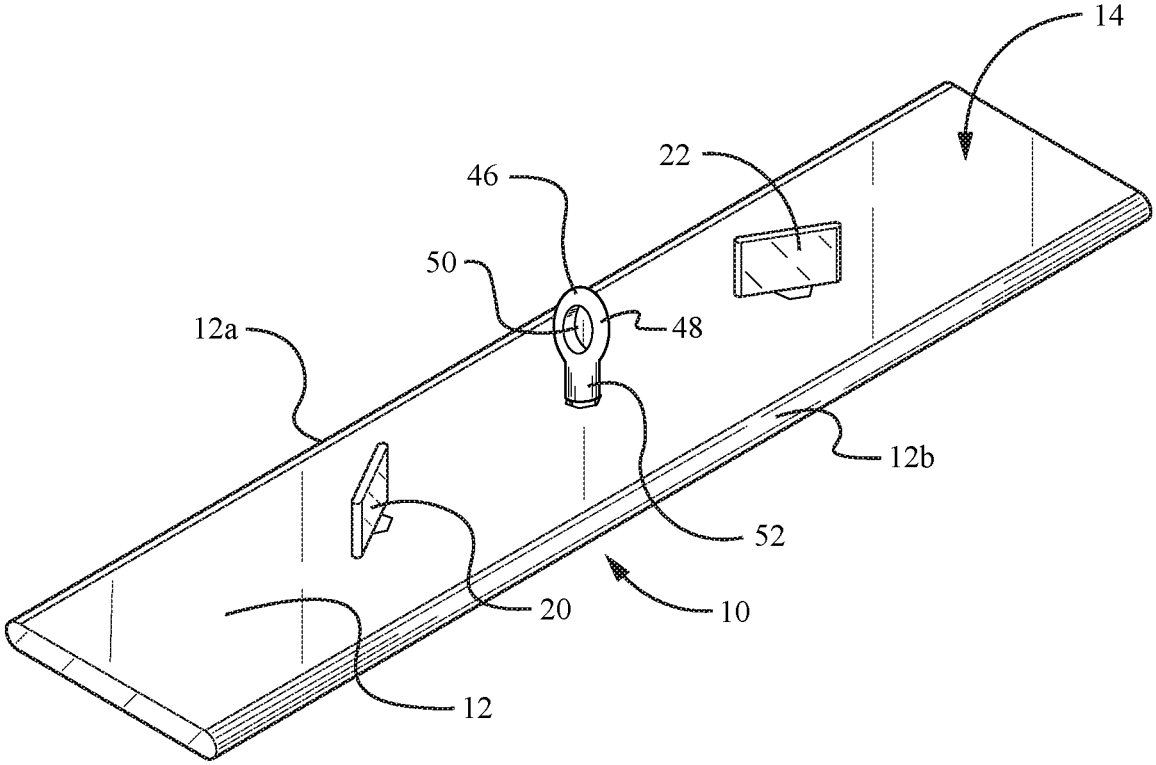
FIG. 1 is a perspective view of a handle assembly with finger stop protrusions, according to one embodiment of the invention.
Figure 2:
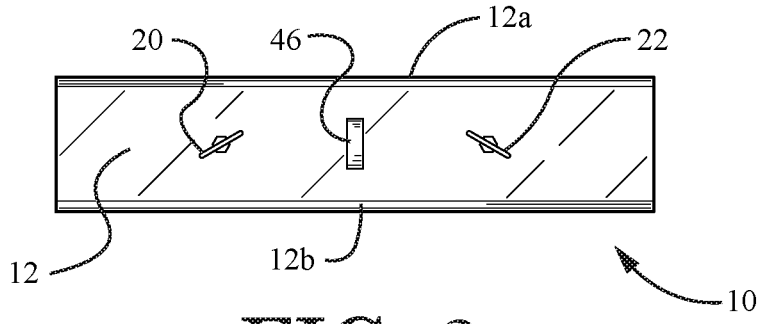
FIG. 2 is a top plan view of the handle assembly of FIG. 1.
Figure 3:
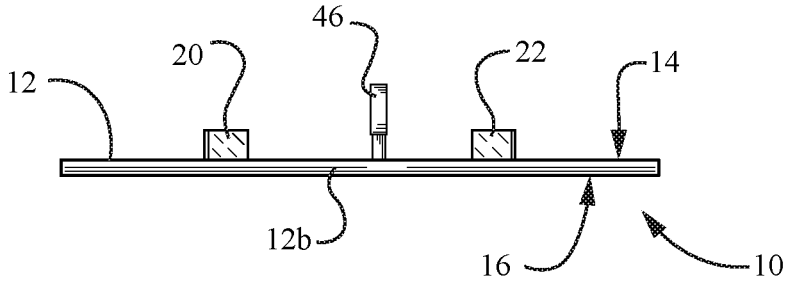
FIG. 3 is a side elevational view of the handle assembly of FIG. 1.
Figure 4:
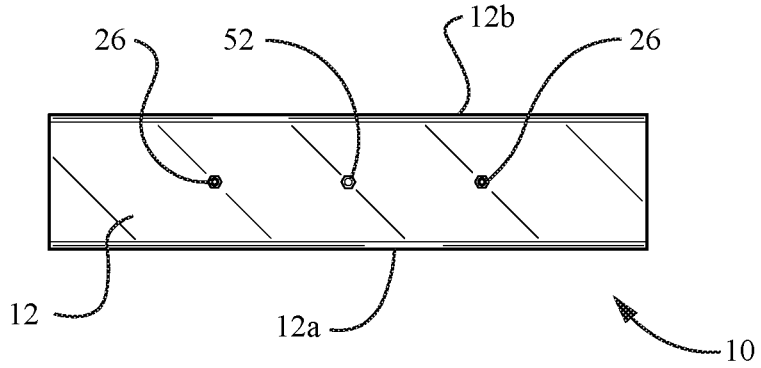
FIG. 4 is a bottom plan view of the handle assembly of FIG. 1.
Figure 5:
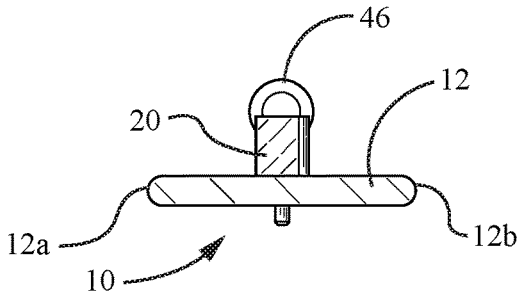
FIG. 5 is a first end view of the handle assembly of FIG. 1.
Figure 6:
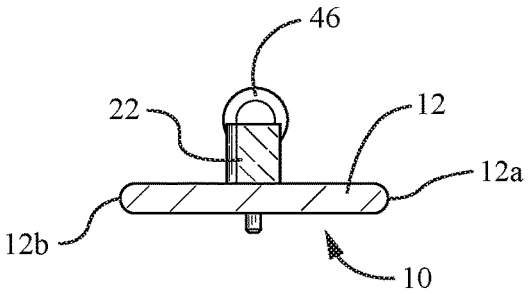
FIG. 6 is a second end view of the handle assembly of FIG. 1.

A first illustrative embodiment of a handle assembly with finger stop protrusions is seen generally at 10 in FIGS. 1-9*a*, 10, and 11. The handle assembly 10 is configured to be attached to a movable or fixed device (e.g., to a cable or chain of weightlifting or exercise equipment) and upon which a hand of a user can perform gripping, pulling, and lifting movements. Referring initially to FIGS. 1, 3, 10, and 11, it can be seen that the handle assembly 10 generally comprises a handle body portion 12, the handle body portion 12 including a first surface 14 and a second surface 16 (see FIG. 3), the second surface 16 being oppositely disposed relative to the first surface 14, the first surface 14 of the handle body portion 12 configured to receive the palms 66 of the hands 64 of a user 62 disposed thereon (see FIGS. 10 and 11), the handle body portion 12 further including a first edge 12*a* and a second edge 12*b*, the second edge 12*b* being oppositely disposed relative to the first edge 12*a*, the first edge 12*a* configured to accommodate a plurality of fingers 68 other than the thumbs 70 of the hands 64 of the user 62 wrapped therearound (see FIGS. 10 and 11); and a pair of spaced-apart finger stop protrusions 20, 22 coupled to and extending outwardly from the first surface 14 of the handle body portion 12, the pair of spaced-apart finger stop protrusions 20, 22 configured to receive the thumbs 70 of the hands 64 of the user 62 pressing thereagainst (see FIG. 11) so that the thumbs 70 of the user 62 are configured to oppose the plurality of fingers 68 of the hand of the user 62 wrapped around the first edge 12*a* so as to create a secure and safe grip of the handle assembly 10 by the user 62 to prevent the hands of the user 62 from slipping off the handle.

Figure 7:
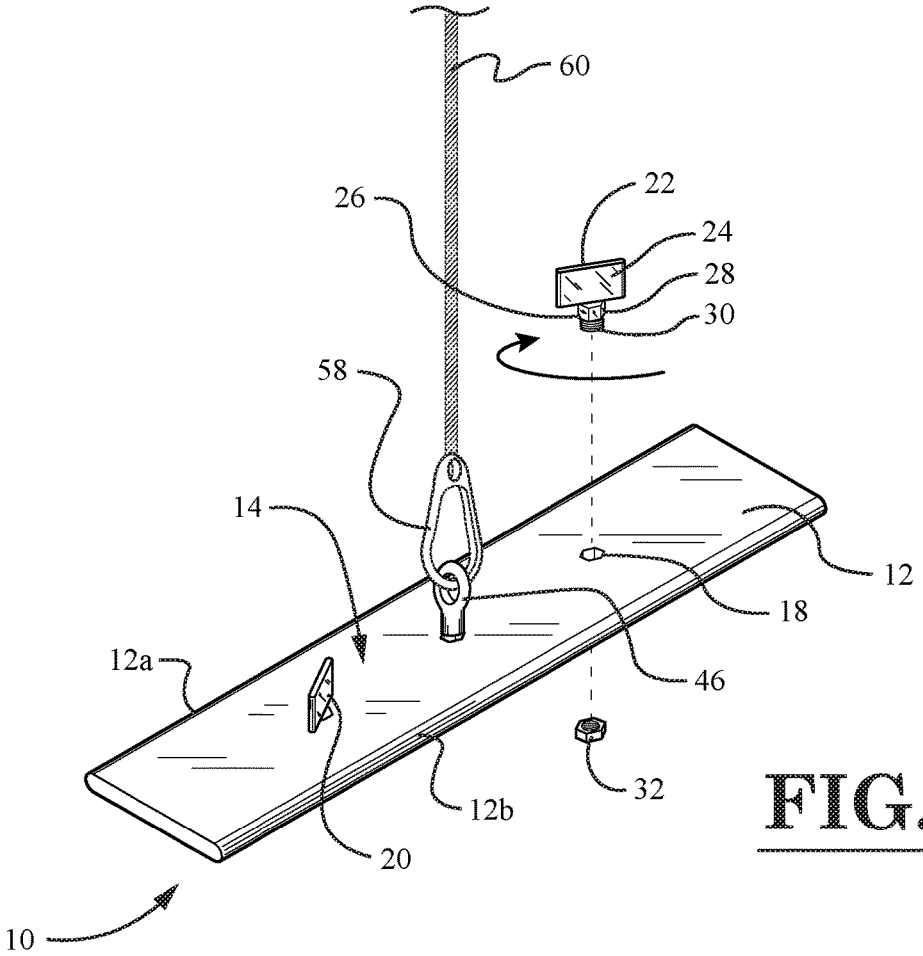
FIG. 7 is a partially exploded perspective view of the handle assembly of FIG. 1, wherein one of the finger stop protrusions is shown exploded from the handle body portion, and wherein the handle assembly is shown attached to a cable.
Figure 8:
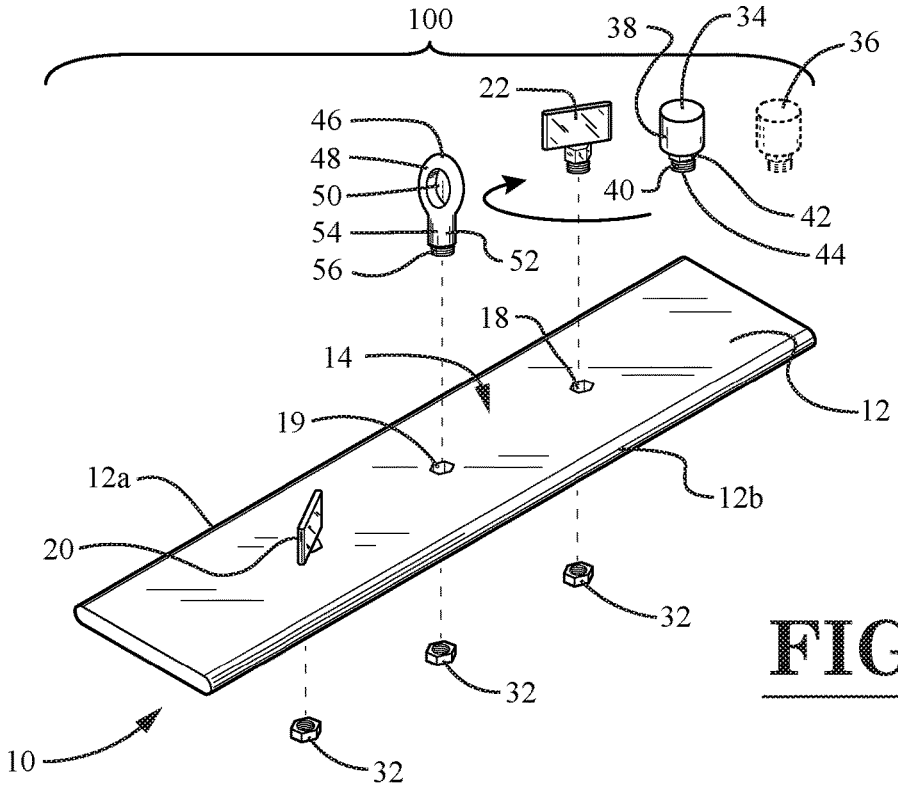
FIG. 8 is another partially exploded perspective view of the handle assembly of FIG. 1, wherein the connector member and one of the finger stop protrusions are shown exploded from the handle body portion, and wherein alternative configurations of finger stop protrusions are illustrated.
Figure 9A:
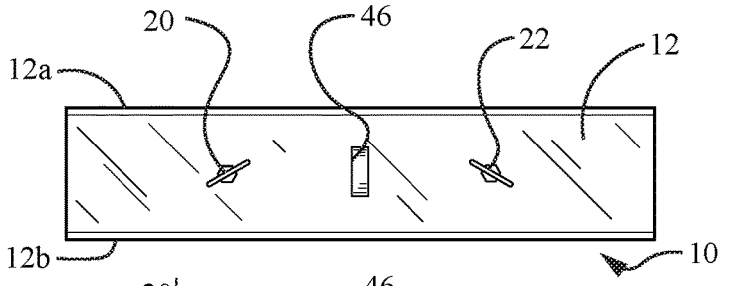
FIG. 9*a* is another top plan view of the handle assembly of FIG. 1, wherein the finger stop protrusions are disposed at acute angles relative to an edge of the handle body portion.
Figure 9B:
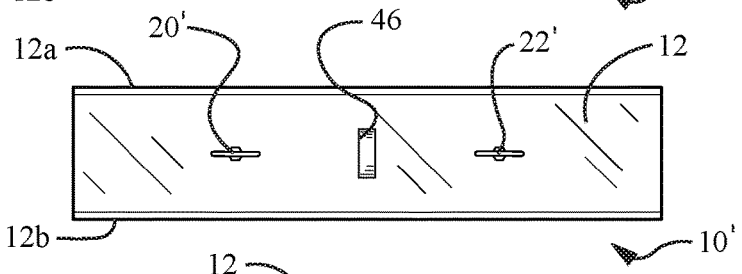
FIG. 9*b* is yet another top plan view of the handle assembly of FIG. 1, wherein the finger stop protrusions are disposed generally parallel to an edge of the handle body portion.
Figure 9C:
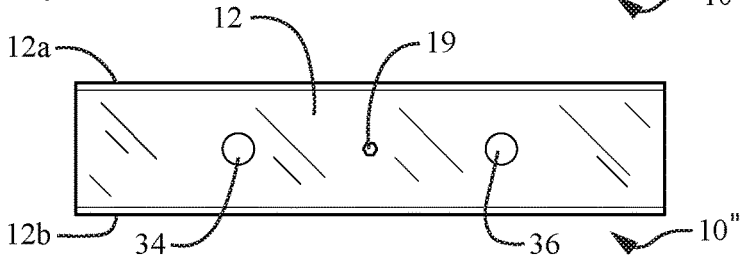
FIG. 9*c* is a top plan view of a handle assembly with finger stop protrusions, according to another embodiment of the invention.

In the illustrative embodiment, with reference to FIGS. 1, 7, and 8, it can be seen that the handle body portion 12 is in the form of an elongate flat bar. As explained above, the first flat surface 14 of the handle body portion 12 is configured to receive the palms 66 of the right and left hands 64 of the user 62 disposed thereon (refer to FIGS. 10 and 11), while the first curved edge 12*a* of the handle body portion 12 is configured to accommodate pluralities of fingers 68 other than thumbs 70 from both the right and left hands 64 of the user 62 wrapped therearound (see FIGS. 10 and 11). For example, as shown in FIG. 10, the user 62 is exercising his arms 63 by pulling down on the handle assembly 10, which may be attached to a stack of weights on a piece of weightlifting or exercise equipment by means of cable 60.

In an exemplary embodiment, the flat bar-shaped handle body portion 12 may be formed from steel, and may have a thickness of approximately ¼ of an inch and a width of approximately 2.0 inches. Advantageously, the flat bar shape of the handle body portion 12 allows for the user 62 (e.g., a weight trainee) to push or pull a weight with more of his or her palm(s) engaged against the resistance. That is, the flat bar shape of the handle body portion 12 enables the user (i.e., the weight trainee) to use more of their hand surface area for a more comfortable grip.

Figure 10:
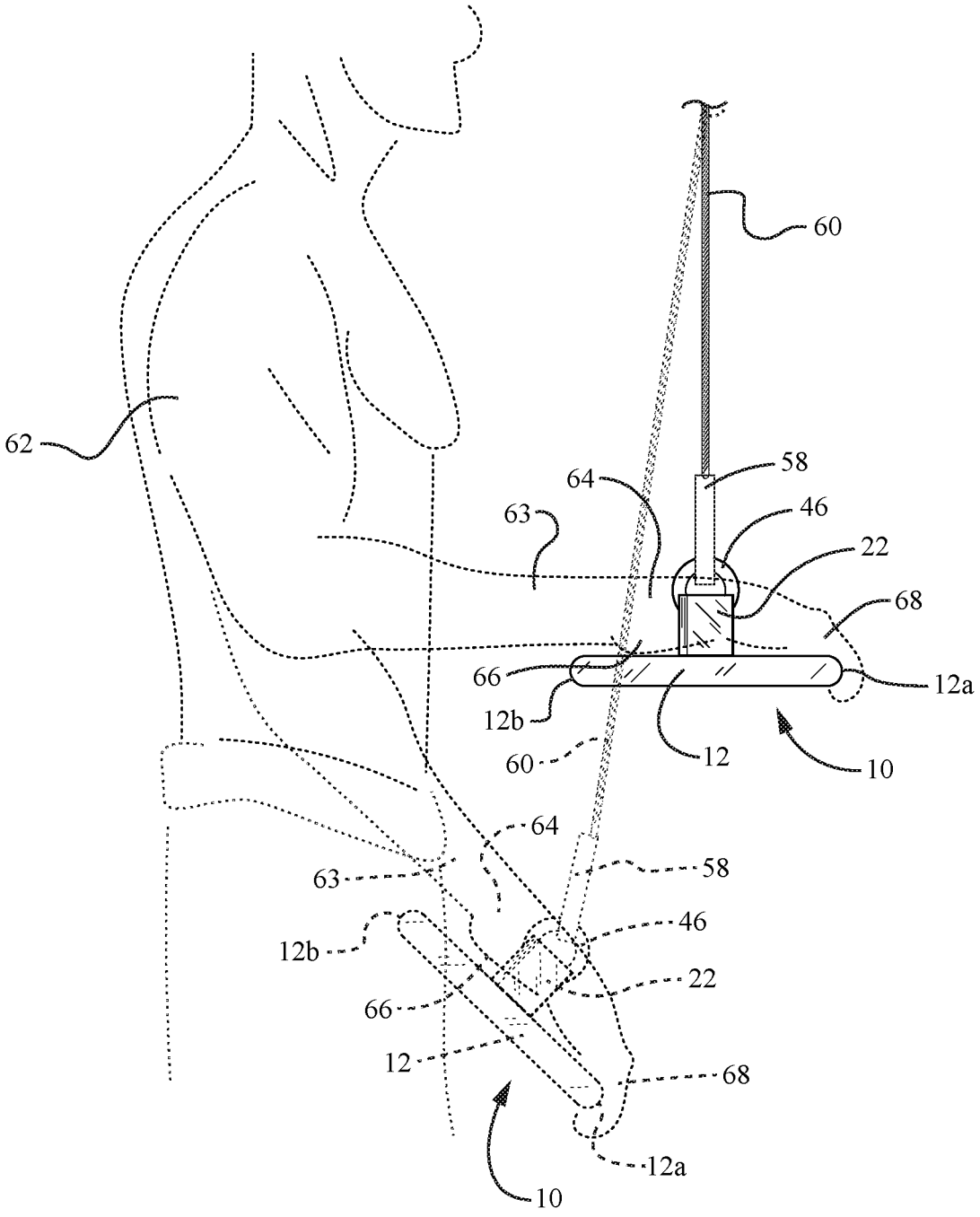
FIG. 10 is a side view illustrating a user pulling down on the handle assembly of FIG. 1.

As best shown in FIGS. 1, 7, and 10, in the illustrative embodiment, the handle assembly 10 further comprises a connector member 46 configured to attach the handle assembly 10 to the movable or fixed device (e.g., to the cable 60 of a piece of weightlifting or exercise equipment, as shown in FIG. 10). Referring to the perspective view of FIG. 1, it can be seen that the connector member 46 comprises a main body portion 48 and a connecting shaft 52 extending outwardly from a bottom side of the main body portion 48. The connecting shaft 52 of the connector member 46 attaches the connector member 46 to the handle body portion 12 by engaging with an aperture 19 disposed in the handle body portion 12 (see FIG. 8). Referring collectively to FIGS. 1, 7, and 10, it can be seen that the main body portion 48 of the connector member 46 comprises an aperture 50 disposed therethrough for receiving a cable connector 58 that attaches the connector member 46 to the movable or fixed device (e.g., to the cable 60 of a piece of weightlifting or exercise equipment—see FIG. 10). That is, in the illustrative embodiment, the connector member 46 is in the form of an eye bolt with an aperture 50 that receives the cable connector 58 looped therethrough (see FIGS. 7 and 10). As best illustrated in the perspective view of FIG. 7, the generally teardrop-shaped cable connector 58 attaches the cable 60 to the connector member 46 of the handle assembly 10, thereby securing the handle assembly 10 to the cable 60 of the piece of weightlifting or exercise equipment.

Turning to FIG. 8, it can be seen that, in the illustrative embodiment, the connecting shaft 52 of the connector member 46 may comprise a non-threaded section 54 and a threaded section 56. In the illustrative embodiment, the non-threaded section 54 of the connecting shaft 52 of the connector member 46 may be received within the aperture 19 of the handle body portion 12, while the threaded section 56 of the connecting shaft 52 of the connector member 46 threadingly engages with a nut 32 for securing the connector member 46 to the handle body portion 12 (refer to FIG. 8). Also, in the illustrative embodiment, the non-threaded section 54 of the connecting shaft 52 of the connector member 46 may be polygonal in shape (e.g., hexagonal in shape) and the aperture 19 of the handle body portion 12 may have a corresponding polygonal shape (e.g., a corresponding hexagonal shape) so as to allow the connector member 46 to be incrementally adjustable in a plurality of different angular orientations relative to the handle body portion 12 by the user 62, while preventing the connector member 46 from being freely rotatable relative to the handle body portion 12.

Figure 11:
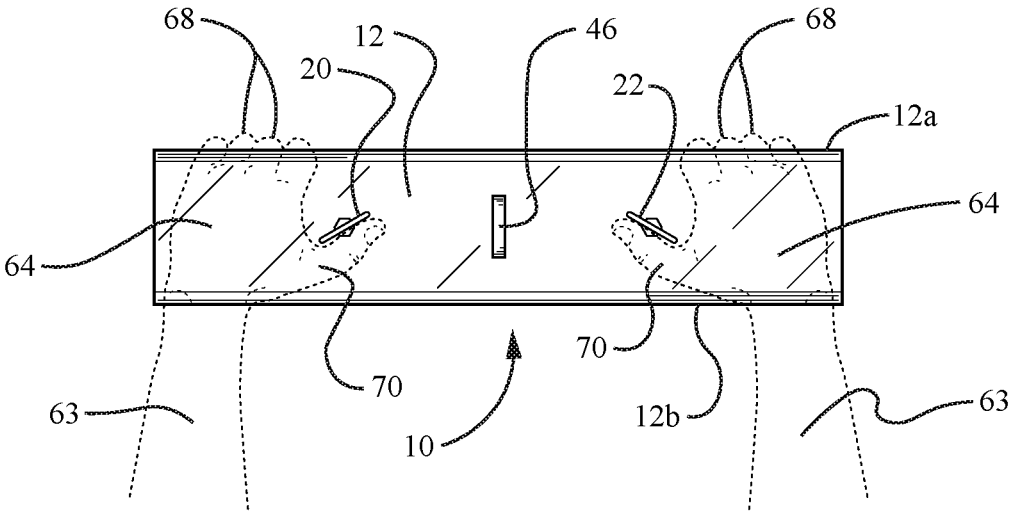
FIG. 11 is still another top plan view of the handle assembly of FIG. 1, wherein a positioning of the hands of a user are depicted on the handle body portion of the handle assembly.

Now, with particular reference to FIGS. 1, 7, and 8, the finger stop protrusions 20, 22 of the illustrative embodiment of the handle assembly 10 will be described in detail. In FIG. 1, it can be seen that the first finger stop protrusion 20 is longitudinally spaced apart from the second finger stop protrusion 22 across the length of the handle body portion 12 of the handle assembly 10. Each of the pair of spaced-apart finger stop protrusions 20, 22 is coupled to, and extends outwardly from the first surface 14 of the handle body portion 12. Also, as best illustrated in the top view of FIG. 11, each of the pair of spaced-apart finger stop protrusions 20, 22 is configured to accommodate a respective thumb 70 of a respective hand 64 of the user 62. Referring to FIG. 7, it can be seen that, in the illustrative embodiment, each of the finger stop protrusions 20, 22 comprises a main body portion 24 and a connecting shaft 26 extending outwardly from a bottom side of the main body portion 24. The connecting shaft 26 of each finger stop protrusion 20, 22 attaches the finger stop protrusion 20, 22 to the handle body portion 12 by engaging with a respective aperture 18 disposed in the handle body portion 12. Referring again to FIG. 7, it can be seen that, in the illustrative embodiment, the connecting shaft 26 of each finger stop protrusion 20, 22 may comprise a non-threaded section 28 and a threaded section 30. In the illustrative embodiment, the non-threaded section 28 of the connecting shaft 26 of each finger stop protrusion 20, 22 is received within the aperture 18 of the handle body portion 12, while the threaded section 30 of the connecting shaft 26 of each finger stop protrusion 20, 22 engages with a nut 32 for securing each finger stop protrusion 20, 22 to the handle body portion 12 (refer to FIGS. 7 and 8). Also, in the illustrative embodiment, the non-threaded section 28 of the connecting shaft 26 of each finger stop protrusion 20, 22 may be polygonal in shape (e.g., hexagonal in shape) and the aperture 18 of the handle body portion 12 may have a corresponding polygonal shape (e.g., a corresponding hexagonal shape) so as to allow each finger stop protrusion 20, 22 to be incrementally adjustable in a plurality of different angular orientations relative to the handle body portion 12 by the user 62, while preventing the finger stop protrusion 20, 22 from being freely rotatable relative to the handle body portion 12. For example, as shown in a first angular orientation in FIG. 9*a*, the longitudinal axis of each finger stop protrusion 20, 22 may be disposed at an acute angle relative to the second edge 12*b* of the handle body portion 12 so as to angularly orient each thumb 70 of the user 62 on the first surface 14 of the handle body portion 12 (i.e., as shown in FIG. 11). Alternatively, as shown in a second angular orientation in FIG. 9*b*, the longitudinal axis of each finger stop protrusion 20', 22' may be disposed generally parallel to the second edge 12*b* of the handle body portion 12.

Figure 12:
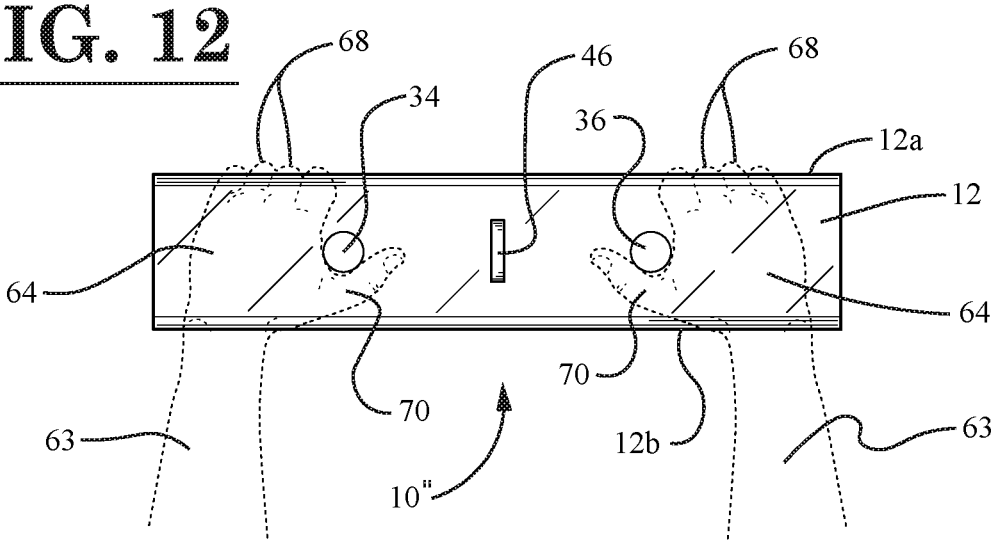
FIG. 12 is another top plan view of the handle assembly of FIG. 9*c*, wherein a positioning of the hands of a user are depicted on the handle body portion of the handle assembly.

In the illustrated embodiment of FIGS. 1-9*b*, 10, and 11, each of the finger stop protrusions 20, 22 has a cross-sectional body shape that is generally flat bar shaped. In the handle assembly 10 of FIG. 9*a*, the longitudinal axis of each flat bar shaped finger stop protrusion 20, 22 is disposed at an acute angle relative to the second edge 12*b* of the handle body portion 12, while in the handle assembly 10' of FIG. 9*b*, the longitudinal axis of each flat bar shaped finger stop protrusion 20', 22' is disposed generally parallel relative to the second edge 12*b* of the handle body portion 12. In other illustrative embodiments, each finger stop protrusion alternatively may have a cross-sectional body shape that is circular, rectangular, square, elliptical, or crescent shaped (i.e., half-moon shaped). For example, as shown in the second illustrative embodiment of FIGS. 9*c* and 12, the handle assembly 10" may be provided with finger stop protrusions 34, 36 having a main body portion 38 with a circular cross-sectional shape. In this alternative embodiment, with reference to FIG. 12, it can be seen that, when the finger stop protrusions 34, 36 are provided with a circular main body portion 38, the thumbs 70 of the user 62 are partially wrapped around the circular outer sides of the finger stop protrusions 34, 36 by the user 62. In one or more embodiments, the handle assembly 10 may be provided with a plurality of different types of finger stop protrusions 20, 22, 34, 36 as part of a handle assembly kit 100 (e.g., as depicted in FIG. 8). As shown in FIG. 8, like the flat bar-shaped finger stop protrusions 20, 22 described above, the circular finger stop protrusions 34, 36 each comprise a main body portion 38 and a connecting shaft 40 extending outwardly from a bottom side of the main body portion 38. The connecting shaft 40 of each circular finger stop protrusion 34, 36 attaches the finger stop protrusion 34, 36 to the handle body portion 12 by engaging with a respective aperture 18 disposed in the handle body portion 12. Referring again to FIG. 8, as described above for the flat bar-shaped finger stop protrusions 20, 22, the connecting shaft 40 of each finger stop protrusion 34, 36 may comprise a non-threaded section 42 and a threaded section 44. In the illustrative embodiment, the non-threaded section 42 of the connecting shaft 40 of each finger stop protrusion 34, 36 is received within the aperture 18 of the handle body portion 12, while the threaded section 44 of the connecting shaft 40 of each finger stop protrusion 34, 36 engages with a nut 32 for securing each finger stop protrusion 34, 36 to the handle body portion 12 (see FIG. 8).

Figure 13:
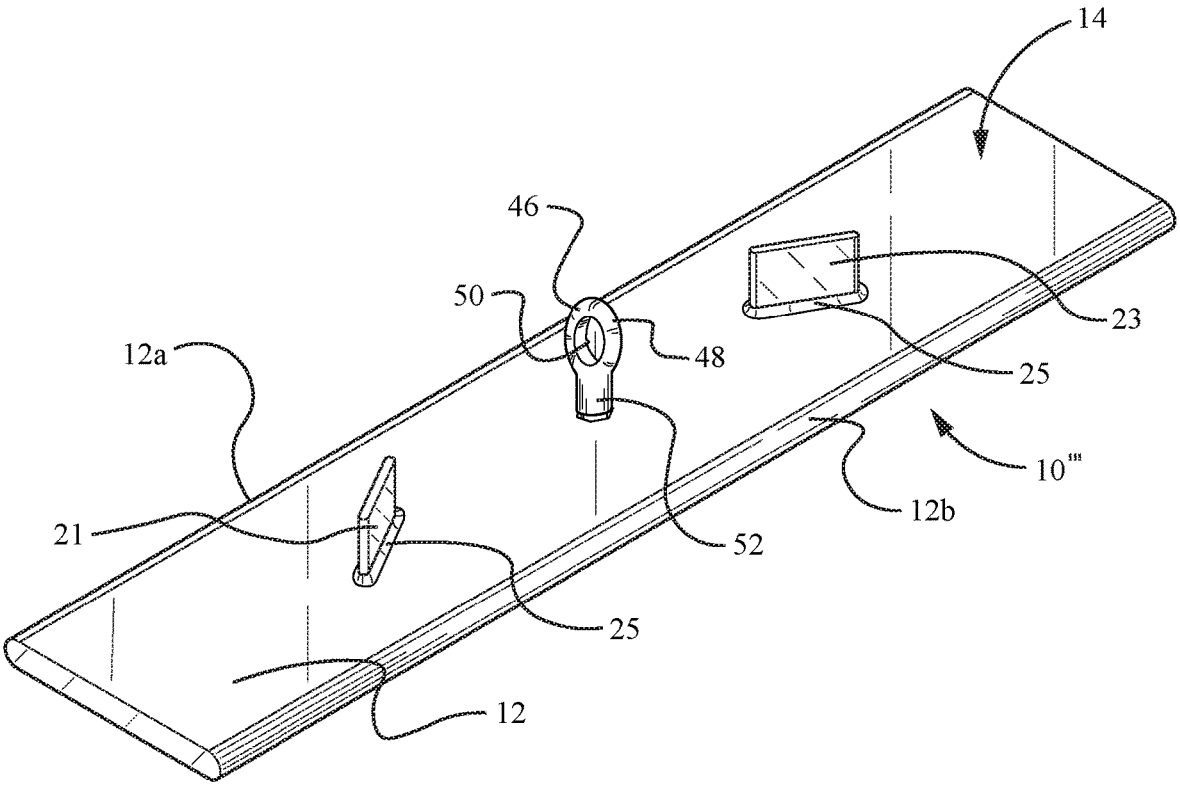
FIG. 13 is a perspective view of a handle assembly with finger stop protrusions, according to yet another embodiment of the invention, wherein the finger stop protrusions are welded onto the handle body portion of the handle assembly.

In the illustrated embodiments of the handle assemblies 10, 10', 10" described above, the finger stop protrusions 20, 22, 34, 36 are removably attached to the handle body portion 12 by means of the threaded connections between threaded shaft sections 30, 44 and their respective nuts 32 so as to allow the finger stop protrusions 20, 22, 34, 36 to be swapped out by the user 62 and/or selectively positioned at a particular angular orientation on the handle body portion 12. In an alternative embodiment, the finger stop protrusions may be fixedly secured to the handle body portion 12 in a permanent manner by welding or other similar means. For example, as shown in the third illustrative embodiment of FIG. 13, the handle assembly 10''' may be provided with finger stop protrusions 21, 23 permanently affixed to the handle body portion 12 by a welded base 25. In this illustrative embodiment, similar to the first illustrative embodiment described above, each flat bar shaped finger stop protrusion 21, 23 is disposed at an acute angle relative to the second edge 12*b* of the handle body portion 12 (see FIG. 13).

In one or more alternative embodiments, rather than the non-threaded sections 28 of the connecting shafts 26 of each finger stop protrusion 20, 22 having a polygonal shape as described above in conjunction with the first illustrative embodiment, the non-threaded sections of the connecting shafts 26 of the finger stop protrusions 20, 22 may be circular in shape and the aperture in the handle body portion 12 may have a corresponding circular shape so as to allow the finger stop protrusions 20, 22 to be rotatably adjusted relative to the handle body portion 12 by the user 62.

Also, in one or more alternative embodiments, rather than utilizing nuts 32 for attaching the finger stop protrusions 20, 22 to the handle body portion 12, the connecting shafts of the finger stop protrusions 20, 22 may comprise a plurality of external threads disposed thereon and the aperture disposed in the handle body portion 12 may comprise a plurality of corresponding internal threads. In these one or more alternative embodiments, the plurality of external threads on the connecting shaft of the finger stop protrusions 20, 22 are threadingly engaged with the plurality of internal threads of the aperture disposed in the handle body portion 12 so as to secure the finger stop protrusions 20, 22 to the handle body portion 12.

In the illustrative embodiments described above, the finger stop protrusions 20, 21, 22, 23, 34, 36 are provided as components of a handle assembly 10, 10', 10", 10'''. However, it is to be understood that, in other embodiments of the invention, the finger stop protrusions 20, 21, 22, 23, 34, 36 may be provided in a retrofit kit for modifying an existing handle member (e.g., an existing handle member of a piece of weightlifting or exercise equipment). For example, in one or more of these other embodiments, the finger stop protrusions may be welded or otherwise secured to the outer surface of an existing handle member (e.g., the finger stop protrusions may be welded to an existing inverted V-shaped handle member).

It is readily apparent that the aforedescribed handle assemblies 10, 10', 10", 10''' and finger stop protrusions 20, 21, 22, 23, 34, 36 provided thereon offers numerous advantages. First, the handle assemblies 10, 10', 10", 10''' described herein provide a user with a safe, secure grip while using a weightlifting handle or bar. The aforedescribed handle assemblies 10, 10', 10", 10''' are particularly well adapted for use with weightlifting and exercise equipment where the achievement of a safe, secure grip is of upmost importance for achieving a beneficial workout. Secondly, the aforedescribed finger stop protrusions 20, 21, 22, 23, 34, 36 of the handle assemblies 10, 10', 10", 10''' provide a buttress for the thumb to push against while a user is grasping a weightlifting handle or bar. Thirdly, the finger stop protrusions 20, 21, 22, 23, 34, 36 described herein are capable of being used to form a buttress on existing weightlifting handles or bars. Finally, the finger stop protrusions 20, 21, 22, 23, 34, 36 described herein are advantageously capable of being attached to an existing weightlifting handle or can be molded or fabricated into a new weightlifting handle.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A handle assembly configured to be attached to a movable or fixed device and upon which a right and/or left hand of a user is capable of performing gripping, pulling, and lifting movements, said handle assembly comprising:

a handle body portion, said handle body portion including a first surface and a second surface, said second surface being oppositely disposed relative to said first surface, said first surface of said handle body portion configured to receive at least one palm of said right and/or left hand of said user disposed thereon, said handle body portion further including a first edge and a second edge, said second edge being oppositely disposed relative to said first edge, said first edge configured to accommodate a plurality of fingers other than a thumb of said right and/or left hand of said user wrapped therearound, said handle body portion being in the form of an elongate flat bar with a length and width, said length of said elongate flat bar being greater than said width of said elongate flat bar, and said first and second edges extending along said length of said elongate flat bar, and said elongate flat bar is configured to allow said at least one palm of said right and/or left hand of said user to extend across said width of said elongate flat bar from said first edge to said second edge;

at least one finger stop protrusion coupled to and extending outwardly from said first surface of said handle body portion, said at least one finger stop protrusion being generally centered between said first edge and said second edge of said handle body portion, said at least one finger stop protrusion comprising a main body portion disposed on said first surface of said handle body portion, and said at least one finger stop protrusion further comprising a connecting shaft extending outwardly from a side of said main body portion, said connecting shaft of said at least one finger stop protrusion passing through an aperture disposed in said handle body portion, said connecting shaft of said at least one finger stop protrusion attaching said at least one finger stop protrusion to said handle body portion by engaging with a nut disposed on said second surface of said handle body portion, said main body portion of said at least one finger stop protrusion configured to receive said thumb of said right and/or left hand of said user pressing thereagainst so that said thumb of said user is configured to oppose said plurality of fingers of said right and/or left hand of said user wrapped around said first edge so as to create a secure and safe grip of said handle assembly by said user; and a connector member configured to attach said handle assembly to said movable or fixed device, wherein said connector member comprises a main body portion and a connecting shaft extending outwardly from a side of said main body portion, said connecting shaft of said connector member configured to attach said connector member to said handle body portion by engaging with a connector recess or connector aperture disposed in said handle body portion, said connector member being generally centered between said first edge and said second edge of said handle body portion.

2. The handle assembly according to claim 1, wherein said first surface of said handle body portion is configured to receive the palms of both the right and left hand of said user disposed thereon, and wherein said first edge of said handle body portion is configured to accommodate the respective pluralities of fingers other than the respective thumbs from both said right and left hands of said user wrapped therearound.

3. The handle assembly according to claim 2, wherein said at least one finger stop protrusion comprises a pair of spaced-apart finger stop protrusions, each of said pair of spaced-apart finger stop protrusions coupled to and extending outwardly from said first surface of said handle body portion, and each of said pair of spaced-apart finger stop protrusions configured to accommodate the respective thumb of the respective right and left hands of said user.

4. The handle assembly according to claim 1, wherein said connecting shaft of said at least one finger stop protrusion comprises a non-threaded section and a threaded section, said non-threaded section of said connecting shaft of said at least one finger stop protrusion configured to be received within said aperture of said handle body portion, and said threaded section of said connecting shaft of said at least one finger stop protrusion configured to engage with said nut for securing said at least one finger stop protrusion to said handle body portion.

5. The handle assembly according to claim 4, wherein said non-threaded section of said connecting shaft of said at least one finger stop protrusion is polygonal in shape and said aperture of said handle body portion has a corresponding polygonal shape so as to allow said at least one finger stop protrusion to be incrementally adjustable in a plurality of different angular orientations relative to said handle body portion by said user, while preventing said at least one finger stop protrusion from being freely rotatable relative to said handle body portion.

6. The handle assembly according to claim 1, wherein a longitudinal axis of said at least one finger stop protrusion is disposed at an acute angle relative to said second edge of said handle body portion so as to angularly orient said thumb of said user on said first surface of said handle body portion.

7. The handle assembly according to claim 1, wherein said main body portion of said connector member comprises an aperture disposed therethrough for receiving a cable or chain for attaching said connector member to said movable or fixed device.

8. The handle assembly according to claim 1, wherein said connecting shaft of said connector member comprises a non-threaded section and a threaded section, said non-threaded section of said connecting shaft of said connector member configured to be received within said connector recess or connector aperture of said handle body portion, and said threaded section of said connecting shaft of said connector member configured to engage with a nut for securing said connector member to said handle body portion.

9. A handle finger stop protrusion configured to be coupled to a handle body portion of a handle assembly, said handle finger stop protrusion comprising:

a main body portion, said main body portion configured to be coupled to and extend outwardly from a first surface of said handle body portion, said main body portion further configured to extend along said first surface of said handle body portion in an extending direction and defining a longitudinal axis in the extending direction, said longitudinal axis of said main body portion configured to be disposed at an acute angle relative to a first edge of said handle body portion, said main body portion configured to receive a thumb of a hand of a user pressing thereagainst so that said thumb of said user is configured to oppose a plurality of fingers other than said thumb of said hand of said user wrapped around a second edge of said handle body portion so as to create a secure and safe grip of said handle assembly by said user, said main body portion configured to angularly orient said thumb of said hand of said user on said first surface of said handle body portion; and a connecting shaft extending outwardly from a side of said main body portion, said connecting shaft configured to pass through an aperture disposed in said handle body portion, and said connecting shaft configured to attach said handle finger stop protrusion to said handle body portion by engaging with a nut disposed on a second surface of said handle body portion, said second surface of said handle body portion being oppositely disposed relative to said first surface of said handle body portion.

10. The handle finger stop protrusion according to claim 9, wherein said connecting shaft comprises a non-threaded section and a threaded section, said non-threaded section of said connecting shaft configured to be received within said aperture of said handle body portion, and said threaded section of said connecting shaft configured to engage with said nut for securing said handle finger stop protrusion to said handle body portion.

11. The handle finger stop protrusion according to claim 10, wherein said non-threaded section of said connecting shaft of said handle finger stop protrusion is polygonal in shape and said aperture of said handle body portion has a corresponding polygonal shape so as to allow said handle finger stop protrusion to be incrementally adjustable in a plurality of different angular orientations relative to said handle body portion by said user, while preventing said handle finger stop protrusion from being freely rotatable relative to said handle body portion.

12. A handle assembly configured to be attached to a movable or fixed device and upon which at least one hand of a user is capable of performing gripping, pulling, and lifting movements, said handle assembly comprising:

a handle body portion, said handle body portion including a first surface and a second surface, said second surface being oppositely disposed relative to said first surface, said first surface of said handle body portion configured to receive a first portion of said at least one hand of said user disposed thereon, said handle body portion further including a first edge and a second edge, said second edge being oppositely disposed relative to said first edge, said first edge configured to accommodate a second portion of said at least one hand of said user wrapped therearound;

at least one protrusion coupled to and extending outwardly from said first surface of said handle body portion, said at least one protrusion comprising a main body portion disposed on said first surface of said handle body portion, said main body portion of said at least one protrusion extending along said first surface of said handle body portion in an extending direction and defining a longitudinal axis in the extending direction, said longitudinal axis of said main body portion of said at least one protrusion being disposed at an acute angle relative to said second edge of said handle body portion, said main body portion of said at least one protrusion configured to receive a third portion of said at least one hand of said user pressing thereagainst so that said third portion of said at least one hand of said user is configured to oppose said second portion of said at least one hand of said user wrapped around said first edge so as to create a secure and safe grip of said handle assembly by said user, said main body portion of said at least one protrusion configured to angularly orient said third portion of said at least one hand of said user on said first surface of said handle body portion; and a connector member configured to attach said handle assembly to said movable or fixed S device, said connector member extending outwardly from said first surface of said handle body portion.

13. A handle assembly configured to be attached to a movable or fixed device and upon which at least one hand of a user is capable of performing gripping, pulling, and lifting movements, said handle assembly comprising:

a handle body portion, said handle body portion including a first surface and a second surface, said second surface being oppositely disposed relative to said first surface, said first surface of said handle body portion configured to receive a palm of said at least one hand of said user disposed thereon, said handle body portion further including a first edge and a second edge, said second edge being oppositely disposed relative to said first edge, said first edge configured to accommodate a plurality of fingers other than a thumb of said at least one hand of said user wrapped therearound, said handle body portion being in the form of an elongate flat bar with a length and width, said length of said elongate flat bar being greater than said width of said elongate flat bar, and said first and second edges extending along said length of said elongate flat bar, and said elongate flat bar is configured to allow said palm of said at least one hand of said user to extend across said width of said elongate flat bar from said first edge to said second edge;

at least one finger stop protrusion coupled to and extending outwardly from said first surface of said handle body portion, said at least one finger stop protrusion being generally centered between said first edge and said second edge of said handle body portion, said at least one finger stop protrusion comprising a main body portion disposed on said first surface of said handle body portion, and said at least one finger stop protrusion further comprising a connecting shaft extending outwardly from a side of said main body portion, said connecting shaft of said at least one finger stop protrusion configured to attach said at least one finger stop protrusion to said handle body portion by engaging with a first recess or first aperture disposed in said handle body portion, said main body portion of said at least one finger stop protrusion configured to receive said thumb of said at least one hand of said user pressing thereagainst so that said thumb of said user is configured to oppose said plurality of fingers of said at least one hand of said user wrapped around said first edge so as to create a secure and safe grip of said handle assembly by said user; and a connector member configured to attach said handle assembly to said movable or fixed device, wherein said connector member comprises a main body portion and a connecting shaft extending outwardly from a side of said main body portion, said connecting shaft of said connector member configured to attach said connector member to said handle body portion by engaging with a second recess or second aperture disposed in said handle body portion, said connector member being generally centered between said first edge and said second edge of said handle body portion.

* * * * *